United States Patent [19]

Franceschina et al.

[11] 3,997,375

[45] Dec. 14, 1976

[54] STEEL HARDENING METHOD

[75] Inventors: Louis E. Franceschina; Fred Haromy, both of Sault Ste. Marie; Frederick William Kruppert, Goulais River, all of Canada

[73] Assignee: The Algoma Steel Corporation, Limited, Sault Ste. Marie, Canada

[22] Filed: Dec. 24, 1974

[21] Appl. No.: 536,135

Related U.S. Application Data

[62] Division of Ser. No. 379,277, July 16, 1973, Pat. No. 3,877,685.

[52] U.S. Cl. ..... 148/143; 148/145; 148/152; 148/157

[51] Int. Cl.[2] ..... C21D 9/14

[58] Field of Search ..... 148/143, 153, 156, 157, 148/145, 152, 155

[56] References Cited

UNITED STATES PATENTS

| | | | |
|---|---|---|---|
| 3,212,766 | 10/1965 | Heinenberg et al. | 148/143 |
| 3,623,716 | 11/1971 | Fritsch et al. | 148/153 |

*Primary Examiner*—R. Dean
*Attorney, Agent, or Firm*—Beveridge, DeGrandi, Kline & Lunsford

[57] ABSTRACT

An apparatus for hardening an elongated steel pipe by quenching the pipe with a cooling medium, particularly water, which apparatus comprises an elongated container dimensioned to receive a hot pipe to be hardened, means for supporting the hot pipe in a predetermined position in said container, a cooling medium nozzle, having a tip, for introducing cooling medium into the pipe through said tip, means for moving said nozzle between a retracted position in which the tip thereof is spaced from an end of said pipe to allow removal and insertion of said pipe with respect to said container and an expanded position in which said tip lies within said end of said pipe, inlet means for introducing cooling medium into said container so as to pass into said pipe through said tip of said nozzle located in said end of said pipe and also to pass around the outside surface of said pipe and an isolator means in fluid communication with said nozzle, movable to vary the relative proportion of volumes of cooling liquid entering through said inlet means which passes into said pipe through said nozzle and around said pipe whereby to control the relative rates of cooling of the inside surface of the outside surface of the pipe. The present invention also provides a method of hardening an elongated steel pipe using said apparatus.

4 Claims, 3 Drawing Figures

FIG.1

STEEL HARDENING METHOD

Figure 1:
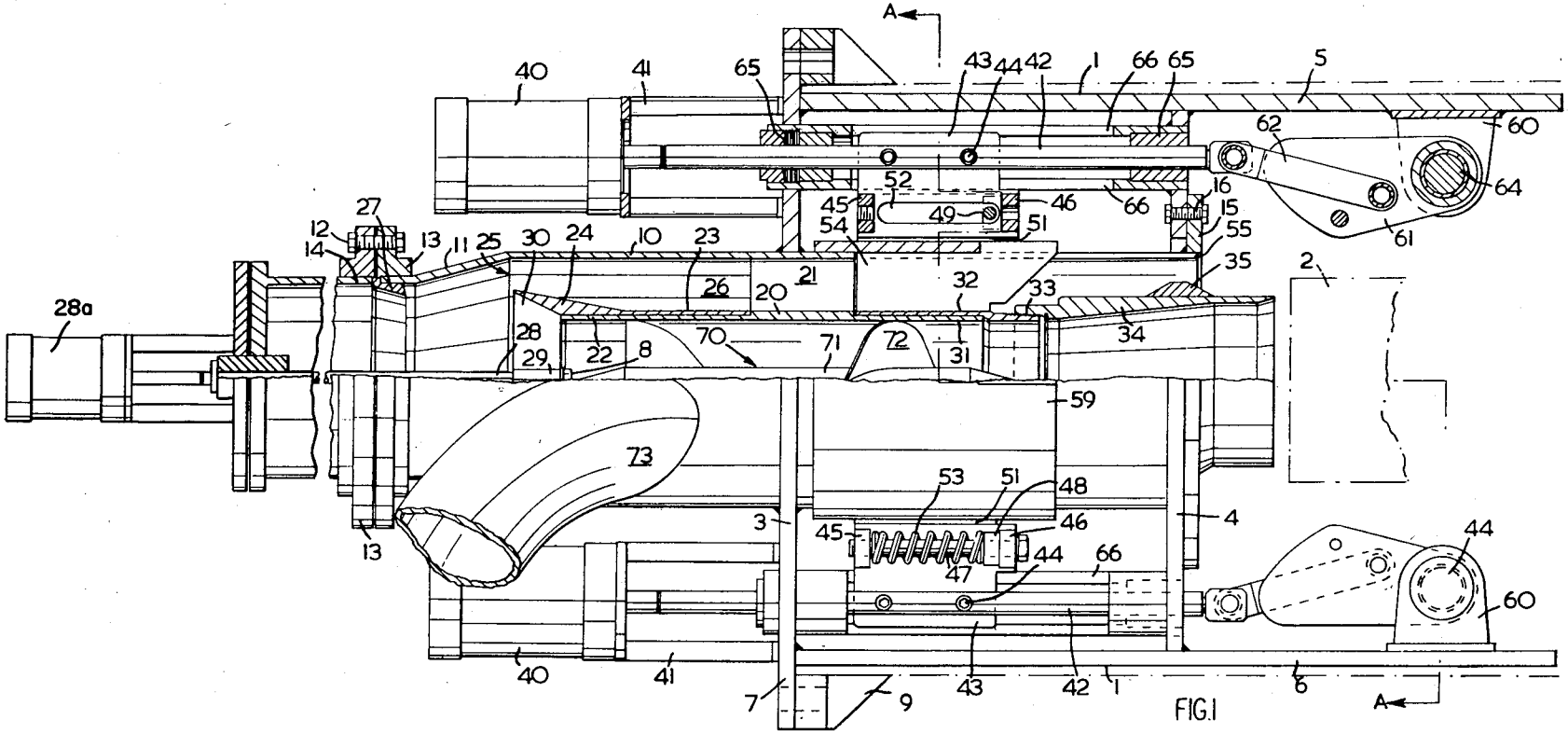

This is a division of application Ser. No. 379,277, filed July 16, 1973, now U.S. Pat. No. 3,877,685.

The present invention relates to the hardening of long steel pipes by quenching such as pipes used in oil fields. In particular, the present invention relates to a method for use in hardening long steel pipe which method may provide for essentially uniform hardening both on the inside and outside surfaces of the pipe.

It is known from U.S. Pat. No. 3,623,716 issued Nov. 30, 1971 to Mannesmann Tube Company Ltd. to harden long steel pipe by passing a cooling liquid, in particular water, from a nozzle in a helical manner through the inside of the hot pipe which is immersed in a bath of the cooling liquid in an elongated container, the outside of the pipe being cooled by passage of liquid thereover primarily due to the suction effect provided by a gap between the end of the pipe and the nozzle which causes circulation of the liquid in the bath. Auxiliary liquid supply means are provided in the bath to cause some helical flow of the liquid over the outside of the tube.

However, it is found that with the apparatus disclosed in the aforesaid U.S. Patent, the flow of liquid over the inside surface of the pipe which is normally substantially faster than the flow of liquid over the outside surface of the pipe provides a faster cooling of the inside surface of the pipe than the outside surface of the pipe. This faster cooling of the inside surface of the pipe is further enhanced by helical flow of cooling medium through the inside surface of the pipe as compared with the essentially linear flow of liquid over the outside surface of the pipe. As a result of the significantly faster cooling of the inside surface of the pipe compared to the cooling of the outside surface of the pipe in the quenching process, the pipe obtained has a different degree of hardness on the inside surface of the pipe than on the outside surface of the pipe. This effect is much more pronounced with small diameter pipe where the relative rates of flow of cooling medium over the inside surface of the pipe to the flow over the outside surface of the pipe becomes substantially different. In particular, for a constant pressure of liquid from the pumps through the nozzle the smaller the diameter of the pipe the faster the liquid flows through the inside of the pipe and thus the greater the difference between the rate of flow of cooling liquid over the inside surface of the pipe as compared with the flow of cooling liquid over the outside surface of the pipe. Further, after reaching a maximum rate of flow through the inside surface of the pipe, when the diameter of the pipe is sufficiently small, the volume of the liquid flowing through the pipe and thus the flow of liquid over both the inside and outside of the pipe will not be substantially increased. Decreasing the pressure of the pumps to reduce the flow of liquid through the inside surface of the pipe does not substantially ameliorate the problem as the volume of liquid circulating through the bath is again decreased and ideally to achieve a substantially uniform hardness both on the inside surface and outside surface of the pipe there should be a substantially similar flow of cooling liquid over both the outside and inside surface of the pipe. While at the present time the oil industry tolerates a small difference in hardness of a few Rockwell hardness points between the inside and outside surface of the pipe, the oil industry always desires as uniform a hardness as possible to reduce hydrogen embrittlement due to the presence of hydrogen sulfide in the oilwell and are always tending to reduce the tolerances between the hardness of the inside and outside surfaces of the pipe which they will accept.

The present invention provides a quenching method for the production of hardened steel pipe in which the difference in hardness of the inside and outside surfaces of the pipe is substantially reduced and is essentially uniform.

It has now been found in accordance with the present invention that by providing an isolator means by which the flow off liquid may be divided between that flowing directly over the outside of the pipe from the inlet means to the container and that flowing through the nozzle through the inside of the pipe may be varied, it is possible to achieve substantially similar flows of cooling fluid over the inside and outside surfaces of the pipe and thus achieve a substantially uniform hardening of both the outside and inside surfaces of the pipe.

Apparatus for hardening an elongated steel pipe by quenching with a liquid cooling medium, particularly water, is described and claimed in parent application Ser. No. 379,277 filed July 16, 1973, said apparatus comprising an elongated container dimensioned to receive the hot pipe to be hardened, means for supporting the hot pipe in a predetermined position in said container, a cooling medium nozzle, having a tip, for introducing cooling medium into the pipe through said tip, means for moving said nozzle between a retracted position in which the tip thereof is spaced from an end of said pipe to allow removal of said pipe from said container and an expanded position in which said tip lies within said end of said pipe, inlet means for introducing cooling medium into said container so as to pass into said pipe through said tip of said nozzle located in said end of said pipe and also to pass around the outside of said pipe and isolator means, in fluid communication with said nozzle, movable to vary the relative proportions of liquid cooling medium entering through said inlet means which passes into said pipe through said nozzle and around said pipe whereby to control the relative rates of cooling of the inside surface and the outside surface of said pipe.

The present invention provides a method of hardening an elongated steel pipe by quenching with a liquid cooling medium which method comprises supporting the hot pipe in an elongated container in a predetermined position and passing said liquid cooling medium from an inlet means directly through the inside of said pipe the improvement in which a proportion of the cooling medium may also pass directly from said inlet means over the outside of said pipe and the relative proportions of the flow of cooling medium from said inlet means directly through said pipe and over said pipe is varied to achieve a desired hardening effect. In a typical operation according to the method of the present invention, the isolator means is moved between a first position providing for maximum flow of cooling liquid around said pipe and a second position in which said cooling liquid entering through said inlet means is caused to flow through said pipe. In such a case, it is essential that there is at least some flow of cooling liquid over the outside surface of said pipe even when said isolator means is directing all the cooling liquid entering through said inlet means through the inside of said pipe and for this purpose a second inlet means is provided for introducing liquid cooling medium into said container so as to pass around the outside of said pipe irrespective of the position of the isolator means.

In a particular embodiment of the apparatus for carrying out the present invention, there is provided a member fixedly mounted longitudinally of the container, a nozzle being mounted adjacent one end thereof for slidable movement therealong between said retracted and expanded position, the isolator means being in fluid connection with said nozzle and being slidably mounted adjacent the other end of the fixed member for progressive movement between a first position in which it is spaced from the inlet means to provide a gap through which a portion of the cooling liquid entering through the first inlet means may pass around the pipe and a second position in which it is connected with the inlet means to receive the flow of cooling medium entering through the inlet means therethrough for passage into the pipe through said nozzle. In a particularly preferred embodiment of the apparatus for carrying out the invention, there is provided a fixed hollow mandrel extending longitudinally of the container the nozzle being in the form of a sleeve slidably mounted thereon adjacent one end thereof for movement between said retracted and expanded positions in said isolator means comprising a sleeve mounted adjacent the other end thereof for progressive movement between a first position in which it is spaced from the inlet means to provide a gap through which a portion of the cooling liquid entering through said first inlet means may pass around said pipe and a second position in which it is connected with said inlet means to receive the flow of cooling medium entering through said first inlet means therethrough for passage into said pipe through said nozzle.

In a particularly preferred embodiment of the apparatus for carrying out the present invention, the inlet means comprises a conduit in an end wall of the container having a hollow mandrel axially and fixedly disposed therein, the nozzle including a sleeve portion and movable axially of said mandrel between the retracted and expanded positions and said isolator means comprising a sleeve mounted on the other end of said mandrel and movable axially of said mandrel said sleeve of said isolator means being adapted during said movement to vary the gap between the sleeve and the wall of the conduit to control the proportions of cooling liquid entering the container through said conduit which pass around said pipe through said nozzle into said pipe. Suitably the sleeve of the isolator means has a flaring skirt portion for varying the size of the gap on axial movement of said sleeve. The conduit suitably has a restricted portion arranged to cooperate with the flared portion of said sleeve of the isolator means to vary the gap. In a preferred embodiment of the apparatus, the sleeve of the isolator means is movable to completely close the gap by contact with the walls of the conduit, means being provided to introduce cooling fluid into the conduit downstream of the contact of said sleeve with the walls of the conduit. The movement of the nozzle is suitably provided for by a plate means fixedly mounted on said nozzle extending through elongated slots in the conduit actuation being provided by means of hydraulic rams. The hydraulic rams are also desirably adapted to actuate clamping members between an operative position in which they grip the hot pipe when they move the nozzle to the expanded position and an inoperative position in which they release the pipe when they move the nozzle to the retracted position. The movement of the isolator means is suitably provided by means of a rod releasably connected to the sleeve of the isolator means.

The hollow mandrel suitably includes a spiral to provide for the helical flow of cooling liquid through the pipe so as to provide for maximum cooling effect. Such an effect is disclosed for example, in U.S. Pat. No. 2,888,374 issued to Heinenberg, May 26, 1959.

The method of the present invention has particular application in the hardening of high carbon steel which hardened steels have a generally martensitic structure. As is known in the quenching of high carbon steel e.g. steels containing from 0.60 to 1.00 percent carbon to produce steels of high hardness it is necessary in order to avoid cracking of the steel due to the high expansion of the steel which occurs when the steel is cooled into the martensitic range, that the quenching of the steel in such martensitic range must be slow. However, in order to avoid pearlite formation in the steel which reduces the strength of the steel, it is necessary in a large number of cases to subject the heated steel initially to a fast quench in order to avoid the steel passing into the pearlite range in the transformation diagram of time and temperature of cooling for a particular high carbon steel. Heretofore, in the hardening of high carbon steels one of three methods has been used namely (a) quenching in salt at 800° C with a subsequent air cool, (b) or quenching in oil as the cooling medium, or (c) adding alloying elements.

Salt quenching provides a delay in the quenching of the steel at 800° C which is the temperature of the salt bath, the hot pipe then being removed from the salt bath and allowed to air cool. The disadvantages in such a process are the use of salt as the cooling medium as opposed to water which is the conventional cooling medium, and further in the subsequent air cooling, particularly with pipes of thick section, there is a non-uniform cooling of the pipe providing hot spots leading to weak points in the hardened steel pipe.

Oil quenching is predicated upon the oil having a lower heat conductivity than water by which means the rate of cooling of the hot pipe can be reduced. However, there is a problem with initial fast cooling that is necessary with some steels which are thus not therefore susceptible to oil quenching without the formation of pearlite grains. Oil quenching is also expensive, slow, dirty, subject to fumes and fire hazards.

The third method is to alloy the steel forming the hot pipe with alloying metals which retard the formation of pearlite grains in the steel as it is cooled and thus allow for an initially slower quench. However, this method substantially increases the cost of the steel.

In using the method of the present invention, the inside cooling of the pipe is the most effective, particularly due to the speed of flow of the cooling liquid through the pipe and the helical flow of the cooling liquid through the inside of the pipe. In order to achieve fast cooling using the apparatus all that is necessary is to direct by means of the isolator means essentially all of the cooling liquid from the first inlet means so as to pass through the inside of the pipe, the outside of the pipe being cooled substantially solely by the cooling medium entering through the second inlet means. Thus, in the quenching of high carbon steel with the method of the present invention, one is not primarily concerned with obtaining a uniform hardness across the pipe and thus the difference between the hardness of the inside and outside of the pipe. In the quenching of high carbon steel with the method of the present invention, one is concerned primarily with initially rapidly quenching the steel down to a selected temperature using water as a quenching medium by passing essentially all the liquid from the first inlet means through the inside of the pipe. Once the selected temperature has been reached the rate of cooling of the hot steel pipe as the steel enters the martensitic range is reduced by the diversion of increasing amounts of water entering through the first inlet means to flow over the outside of the pipe. The selected temperature at which the rate of cooling of the hot pipe is reduced is below the pearlite range in the aforesaid phase diagram. It is allowable once this selected temperature has been reached and sometimes desirable to reduce the rate of cooling to adopt the quenching process called martempering or mod. martempering by which the formation of martensite occurs fairly uniformly, avoiding excessive residual stresses, as the greatest thermal variations occur while the steel is in a relatively plastic austenitic condition. Also the dimensional change when forming martensite occurs over a longer time against conventional quenching. Martempering practically eliminates quench cracking.

Figure 2:
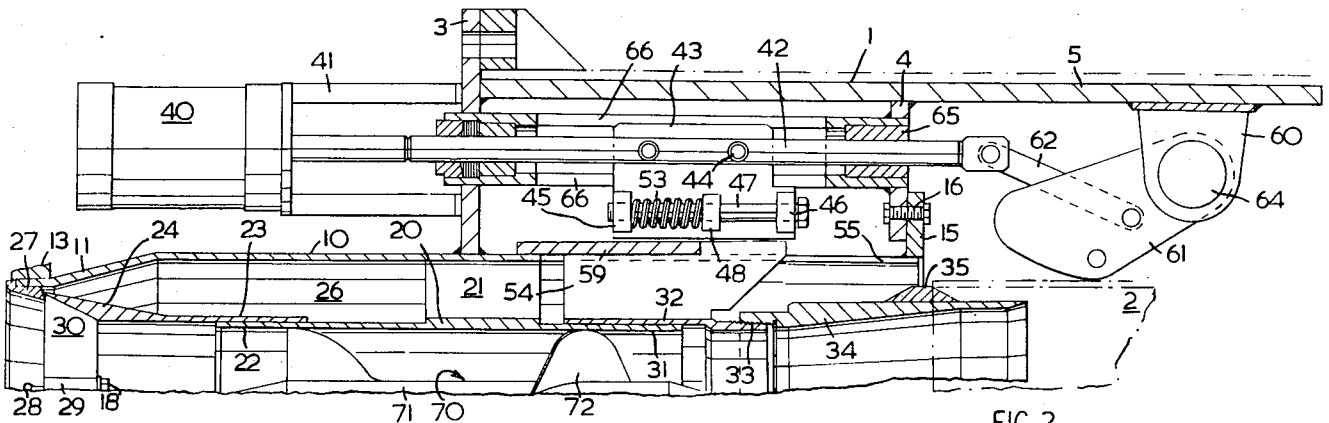
Figure 3:
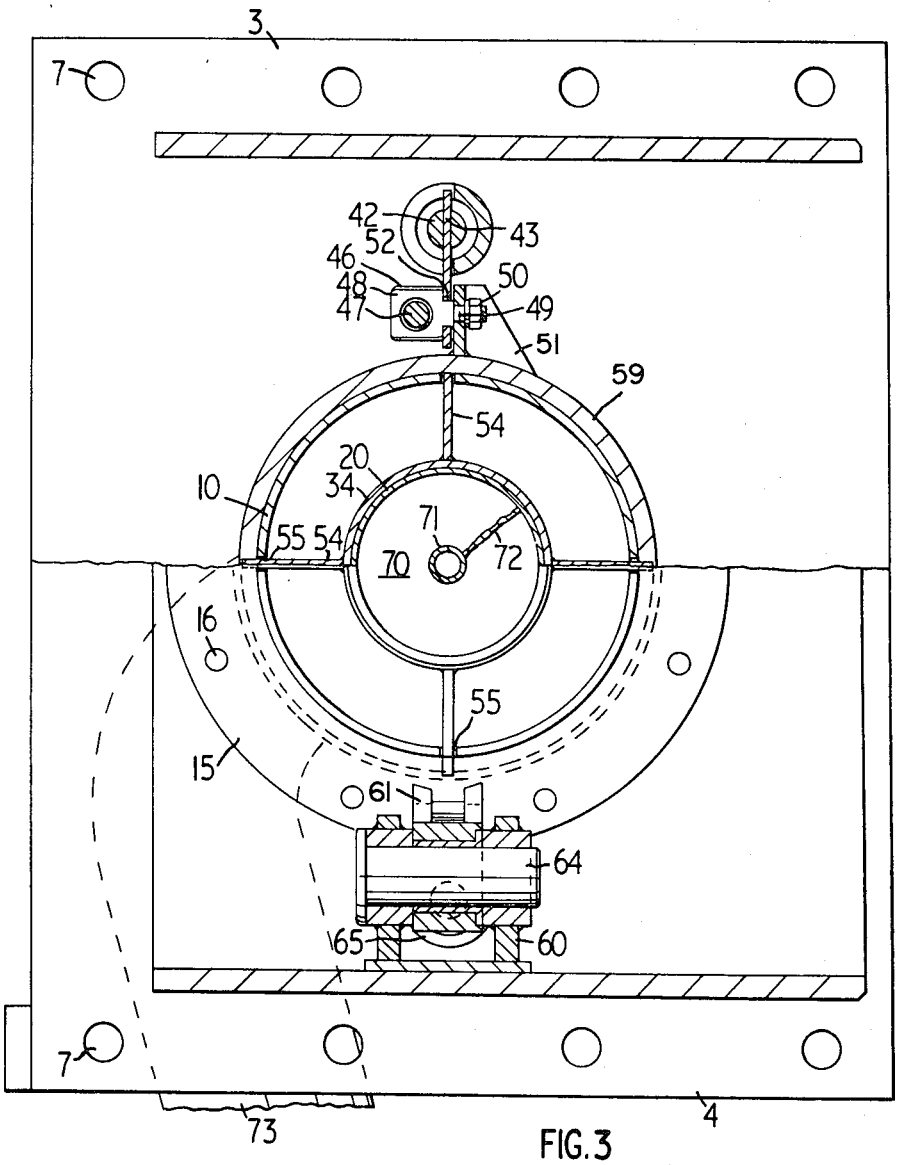

The present invention will be further illustrated by way of the accompanying drawings:

FIG. 1 is a plan elevation partially broken away of an apparatus for use in hardening steel pipe in accordance with a particular embodiment of the present invention, FIG. 2 is a plan elevation similar to the part of FIG. 1 that is broken away in which the nozzle and clamp are in their operative positions, and the isolator is in its second position so as to direct all the cooling medium from the inlet to the inside of the pipe, and FIG. 3 is a section taken along the line A—A in FIG. 1.

Referring to the drawings, the unit shown therein is adapted in dimension to be fitted into the end wall of an elongated container 1 in which the pipe 2 is disposed at a predetermined height. Such a container 1 and mechanisms for delivering the hot pipe 2 to the container retaining it in the container at a predetermined height and subsequently removing it from the container is conventional and is as disclosed in U.S. Pat. No. 3,623,716 and thus is not described in further detail herein.

The unit comprises steel plates 3, 4, 5 and 6 which are welded together to form a framework. The steel plate 3 forms the end wall of the container 1 and is bolted to the side walls of the container 1 by means of bolts (not shown) passing through holes 7 in the plate 3 and lugs 9 on the side walls of the container 1.

A steel conduit 10 which serves as the inlet for the cooling medium, e.g. water to the container 1 extends to the plate 3 and is welded thereto. The end thereof outside the container 1 is restricted at 11 and is bolted by means of bolts 12 and lugs 13 to the supply conduit 14. The other end of the conduit 10 has a flange 15 welded thereto through which it is mounted in position by means of bolts 16 to extend through the plate 4.

A hollow mandrel 20 is fixedly mounted in the conduit 10 by means of four plates 21 disposed in planes at right angles to each other so as to extend axially of sid conduit 10. An isolator sleeve 23 is axially sliably mounted on one end 22 of the mandrel 20 the sleeve 23 having a flaring skirt 24. The isolator sleeve 23 may be moved progressively from the position shown in the FIG. 1 where there is a gap 25 between the end of the sleeve 23 and the wall of the conduit 10 under which conditions cooling medium may flow both through the mandrel 20 and around the mandrel 20 through the annular space 26 via the gap 25 and the position shown in FIG. 2 where the end of the sleeve 23 locates in a lug 27 on the wall of the conduit 10 to close the gap 25 whereby the cooling medium may flow only through the mandrel 20. This movement is achieved by means of a rod 28 fixedly mounted by means of a bolt head 8 in a sleeve 29 which sleeve 29 is centrally mounted in the skirt 24 of the isolator sleeve 23 by means of four fins 30 disposed in planes at right angles to each other. This rod is actuated by means of a hydraulic cylinder 28a attached to the back of a supply line at an "L" connection.

At the other end 31 of the mandrel 20, a nozzle sleeve 32 is slidably axially mounted and has a threaded nut 33 by which a nozzle tip 34 of the required dimensions is attached thereto. The sleeve 32 is movable from a retracted position as shown in FIG. 1 in which it is spaced from the end of the hot pipe 2 in the container 1 to an expanded position as shown in FIG. 2 in which it is located within the end of the hot pipe 2 the gasket member 35 forming a seal with the end of the pipe 2 in this position.

Movement of the sleeve 32 between the retracted and extended positions is achieved by means of a pair of hydraulic rams 40 which are mounted by frames 41 on the outside of the plate 3. The piston rod 42 of each ram 40 extends through the plates 3 and 4 and is slidable in bushings 65. A plate 43 is bolted by bolts 44 to each of the rods 42. Each plate 43 is slidable with the piston rod 42 on frame members 66 which connects the bushings 65. Each plate 43 has welded thereto a threaded lug 45 and an unthreaded lug 46. A bolt 47 extends through the unthreaded lug 46 and is screwed into position in the threaded lug 45. A lug 48 is slidably mounted on the shank of the bolt 47, the lug 48 being fixedly mounted by means of a spigot 49 and nut 50 on a gusseted plate 51. Spigot 49 is movable in a slot 52 in the plate 43 and a spring 53 extends between the lugs 45 and 48. The plate 51 is welded to a sleeve 59 slidable axially of the conduit 10. The sleeve 59 is fixedly connected to the sleeve 32 by means of four plates 54 which are in planes at right angles to each other and are slidable in slots 55 in the conduit 10. Thus, actuation of the hydraulic rams 40 in either direction causes actuation of the sleeve 59 in the same directions via the plate 43, lug 45, spring 53, lug 48, and plate 51. Sleeve 59 moves sleeve 32 in the same direction by means of plates 54 which are movable in slots 55.

It will be seen from FIG. 2 that when the nozzle sleeve 32 is in the extended position, some compression of the spring 53 may be achieved due to the slidability of the bolt 47 in the lugs 46 and 48. This compression provides for a fast response when the nozzle sleeve 32 has started to its retracted position by the hydraulic rams 40.

Each wall 5 and 6 has a pivot mounting 60 including pivot pin 64 on which pivot pin 64 is mounted a clamping member 61 which is movable by means of links 62 which are pivotally mounted both to the end of the piston rod 42 and the clamping member 61 between a retracted position as shown in FIG. 1 and a clamping position shown in FIG. 2 in which it grips the pipe 2 and holds it in position.

In order to provide efficient cooling, a vortical flow of cooling medium through the inside of the pipe 2 is desirable. This is provided by a helical member 70 disposed axially in the mandrel 20 and comprises a spindle 71 and a helix 72. The helix 72 is welded to the inside surface of the mandrel 20.

It is essential to avoid cracking of the steel pipe 2 that there is always a flow of cooling medium over the outside of the pipe. As the flow of cooling medium from the supply conduit 44 in the position of the isolator sleeve 23 shown in FIG. 2 will only pass through the inside of the pipe 2 an auxiliary supply of cooling medium is supplied to flow continuously on the outside of the pipe 2 from an inlet conduit 73 which joins the conduit 10 at a point downstream of the gap 25.

The embodiments of the invention in which an exclusive property or privilege is claimed are defined as follows:

1. A method of hardening an elongated steel pipe by quenching with a liquid cooling medium comprising:

a. supporting a hot pipe to be hardened in a container in predetermined relationship to a first inlet means;

b. flowing liquid cooling medium directly from the first inlet means longitudinally through the inside of the pipe while at the same time passing a flow of the cooling medium in the same direction over the outside of the pipe;

c. and varying the rate of flow of liquid cooling medium passing through the inside of the pipe relative to the rate of flow of cooling medium flowing over the outside of the pipe to control the rate of cooling of the inside surface of the pipe relative to the rate of cooling of the outside surface of the pipe to produce a substantially uniform surface hardness on the inner and outer surfaces of the pipe regardless of the diameter of the pipe being hardened.

2. The method of claim 1 wherein at least a portion of said liquid cooling medium which flows over the outside of said pipe is supplied to said pipe by a second inlet means.

3. The method of claim 1 wherein said rate of flow of cooling medium through the inside of the pipe is varied relative to the rate of flow of cooling medium passing over the outside of the pipe by causing a portion of the cooling medium flowing from said first inlet means to flow over the outside of the pipe to reduce the rate of flow through the inside of the pipe relative to the rate of flow over the outside of the pipe.

4. The method of claim 3 wherein the hot pipe is hardened by initially passing substantially all the flow from said first inlet means through the inside of the pipe to provide for relatively rapid cooling of the pipe down to a pre-selected temperature, and then effecting said reduction of flow rate through the inside of the pipe relative to the flow rate over the outside of the pipe to provide for a selected reduced rate of cooling of the pipe.

* * * * *